US006394675B1

(12) United States Patent
Sodeyama et al.

(10) Patent No.: US 6,394,675 B1
(45) Date of Patent: May 28, 2002

(54) TAPE PRINTING APPARATUS

(75) Inventors: Hideo Sodeyama, Matsumoto; Hiroshi Kobayashi, Shiojiri, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/632,818

(22) Filed: Aug. 7, 2000

(30) Foreign Application Priority Data

Aug. 12, 1999 (JP) ..... 11-228885

(51) Int. Cl.[7] ..... B41J 11/26

(52) U.S. Cl. ..... 400/615.2; 400/208; 400/231; 400/54; 400/621

(58) Field of Search ..... 400/615.2, 208, 400/231, 54, 621

(56) References Cited

U.S. PATENT DOCUMENTS

| | | | | |
|---|---|---|---|---|
| 4,815,874 A | * | 3/1989 | Richardson et al. | 400/208 |
| 5,536,092 A | * | 7/1996 | Yamaguchi | 400/231 |
| 5,634,728 A | * | 6/1997 | Nunokawa et al. | 400/54 |
| 5,934,812 A | * | 9/1999 | Nunokawa et al. | 400/621 |
| 6,089,770 A | | 7/2000 | Kamijo et al. | 400/615.2 |
| 6,126,344 A | * | 10/2000 | Takayama et al. | 400/615.2 |

* cited by examiner

*Primary Examiner*—Ren Yan
*Assistant Examiner*—Marvin P. Crenshaw
(74) *Attorney, Agent, or Firm*—Hogan & Hartson, L.L.P.

(57) ABSTRACT

There is provided provide a tape printing apparatus which is capable of properly operating a tape feed mechanism and a tape cutting mechanism by the use of a single motor. The tape printing apparatus is capable of printing on a printing tape while feeding the printing tape by unwinding a roll of the printing tape, and cutting off a printed portion of the printing tape. A tape feed mechanism feeds the printing tape. A tape cutting mechanism cuts the printing tape. A single motor is capable of performing rotation in normal and reverse directions. A feed mechanism-side gear train transmits torque of the motor to the tape feed mechanism to cause the tape feed mechanism to operate. A cutting mechanism-side gear train transmits the torque of the motor to the tape cutting mechanism to cause the tape cutting mechanism to operate. A clutch mechanism is interposed between the motor, and the feed mechanism-side gear train and the cutting mechanism-side gear train, for performing switching operation to selectively transmit the torque of the motor in one of the normal and reverse directions to the feed mechanism-side gear train, and the torque of the motor in another of the normal and reverse directions to the cutting mechanism-side gear train.

16 Claims, 9 Drawing Sheets

TAPE PRINTING APPARATUS

BACKGROUND OF THE INVENTION

1. Field of the Invention

This invention relates to a tape printing apparatus which is capable of printing on a printing tape while feeding the printing tape from a tape cartridge loaded therein and cutting off the printed portion of the printing tape.

2. Prior Art

In a conventional tape printing apparatus, a tape cartridge containing a roll of a printing tape and a roll of an ink ribbon is removably loaded in a main unit of the apparatus. The main unit contains a print head which faces the tape cartridge loaded in the main unit, a tape feed mechanism for simultaneously feeding both the printing tape and the ink ribbon, and a tape cutting mechanism for cutting off a printed portion of the printing tape. The tape feed mechanism feeds the printing tape and the ink ribbon in a state placed one upon the other, and the print head faces toward the printing tape and the ink ribbon fed by the tape feed mechanism, for printing on the printing tape as desired. During the printing operation, used part of the ink ribbon is taken up within the tape cartridge, and a printed portion of the printing tape alone is sent out of the main unit via a tape exit. When the printing operation is completed, the printed portion of the printing tape is cut off by the tape cutting mechanism and discharged from the apparatus. The tape feed mechanism and the tape cutting mechanism each include a motor as a drive source, and are subject to centralized control by a controller.

In the above conventional tape printing apparatus, the tape feed mechanism and the tape cutting mechanism as output ends of the driving system of the apparatus are different in the manner and timing of operation, and therefore the two mechanisms are required to be driven by respective different motors. This results in an increase in the number of component parts and space for installation of the same.

SUMMARY OF THE INVENTION

It is an object of the invention to provide a tape printing apparatus which is capable of properly operating a tape feed mechanism and a tape cutting mechanism by the use of a single motor.

To attain the above object, the present invention provides a tape printing apparatus a tape printing apparatus which is capable of printing on a printing tape while feeding the printing tape by unwinding a roll of the printing tape, and cutting off a printed portion of the printing tape.

The tape printing apparatus according to the invention is characterized by comprising:

- a tape feed mechanism for feeding the printing tape;
- a tape cutting mechanism for cutting the printing tape;
- a single motor which is capable of performing rotation in normal and reverse directions;
- a first torque transmitting mechanism for transmitting torque of the motor to the tape feed mechanism to cause the tape feed mechanism to operate;
- a second torque transmitting mechanism for transmitting the torque of the motor to the tape cutting mechanism to cause the tape cutting mechanism to operate; and
- a clutch mechanism interposed between the motor, and the first torque transmitting mechanism and the second torque transmitting mechanism, for performing switching operation to selectively transmit the torque of the motor in one of the normal and reverse directions to the first torque transmitting mechanism, and the torque of the motor in another of the normal and reverse directions to the second torque transmitting mechanism.

According to this tape printing apparatus, when the motor performs normal rotation, for instance, the torque of the motor is transmitted by the clutch mechanism via the first torque transmitting mechanism to the tape feed mechanism to feed the tape, while when the motor performs reverse rotation, the torque of the motor is transmitted by the clutch mechanism via the second torque transmitting mechanism to the tape cutting mechanism to cut off the printed portion of the tape. That is, it is possible to feed the printing tape by rotation of the motor in one direction and cut off the printed portion of the tape by rotation of the same in the other direction.

Preferably, the tape printing apparatus includes an output gear from which the torque of the motor is output, and a rotational shaft on which the output gear is rigidly fitted, the first torque transmitting mechanism including a feed mechanism-side gear train for transmitting the torque of the motor to the tape feed mechanism, the feed mechanism-side gear train having an input gear, the second torque transmitting mechanism including a cutting mechanism-side gear train for transmitting the torque of the motor to the tape cutting mechanism, the cutting mechanism having an input gear, the clutch mechanism including a planet gear mating with the output gear, and a carrier having one end thereof supporting the planet gear such that the planet gear is rotatable thereon and another end thereof loosely fitted on the rotational shaft on which the output gear is rigidly fitted such that the carrier is capable of pivotal movement, by frictional drag, with rotation of the rotational shaft, the planet gear being mated with the input gear of the feed mechanism-side gear train by the rotation of the motor in the one of the normal and reverse directions, and mated with the input gear of the cutting mechanism-side gear train by the rotation of the motor in the another of the normal and reverse directions.

According to this preferred embodiment, when the motor performs the normal rotation, for instance, the carrier of the clutch mechanism pivotally moves or swings in one direction, by frictional drag, with rotation of the rotational shaft on which the output gear is fitted to cause the planet gear to automatically mate with the input gear of the feed mechanism-side gear train, whereby torque of the output gear is transmitted to the input gear of the feed mechanism-side gear train via the planet gear. On the other hand, when the motor performs the reverse rotation, the carrier of the clutch mechanism pivotally moves or swings in the other direction, by frictional drag, with rotation of the rotational shaft on which the output gear is fitted to cause the planet gear to automatically mate with the input gear of the cutting mechanism-side gear train, whereby the torque of the output gear is transmitted to the input gear of the cutting mechanism-side gear train via the planet gear. As described above, the switching between the normal and reverse rotations of the motor causes automatic switching of the clutch mechanism, and hence the supply of the driving force can be automatically switched. Further, the use of the planet gear permits the clutch mechanism to be simplified in construction.

Preferably, the tape printing apparatus includes an ink ribbon to be fed in a state placed upon the printing tape, the tape feed mechanism including a platen for feeding the printing tape and the ink ribbon in a state placed one upon another, a platen shaft for rotating the platen, a ribbon take-up reel for taking up the ink ribbon, and a ribbon take-up shaft for rotating the ribbon take-up reel, the feed mechanism-side gear train including a platen gear on which the platen shaft is coaxially secured and a take-up gear on which the ribbon take-up shaft is coaxially secured, as respective output ends thereof.

According to this preferred embodiment, by rotating the platen shaft and the ribbon take-up shaft via the platen gear and the take-up gear, respectively, the printing tape and the ink ribbon can be properly fed together in a state placed one upon the other.

More preferably, the tape cutting mechanism includes a stationary blade and a movable blade that perform relative motion therebetween for cutting operation, and a crank disk for engaging with the movable blade to cause the movable blade to effect the cutting operation, and the cutting mechanism-side gear train includes a cutter gear coaxially secured to the crank disk as an output end of the cutting mechanism-side gear train.

According to this preferred embodiment, by rotating the crank disk via the cutter gear, it is possible to cause the movable blade to perform a proper cutting operation. It is preferable that the stationary blade and the movable blade form a cutter in the form of scissors.

Further preferably, the tape printing apparatus includes a tape exit from which the printed portion of the printing tape is discharged, and a tape holding mechanism associated with the tape exit and linked to the tape cutting mechanism, for holding the printed portion cut off by the tape cutting mechanism at the tape exit.

Still more preferably, the tape printing apparatus includes a control block for controlling the rotation of the motor, and the control block controls the rotation of the motor such that when the movable blade has reached a cutting terminal portion as an end position in a cutting direction of the movable blade by the rotation of the motor in the another of the normal and reverse directions, the printed portion is held at the tape exit by the tape holding mechanism.

Even further preferably, the tape printing apparatus includes a printing block for printing on the printing tape, the motor including a rotational shaft, the crank disk having a peripheral surface and a recess formed in the peripheral surface, the recess having an arcuate profile in cross-section, the control block including an encoder arranged in proximity to the rotational shaft of the motor, for detecting a rotational angle through which the rotational shaft of the motor rotates, and a detection switch in abutment with the peripheral surface of the crank disk, the detection switch moving into the recess when the movable blade has reached a cutting wait position, and generating a cutting wait position detection signal indicative of the cutting wait position of the movable blade, the control block causing the motor to rotate in the another of the normal and reverse directions in response to a print command to thereby cause the movable blade to be pivotally moved to the cutting wait position, and in response to the cutting wait position detection signal, causing the motor to rotate in the one of the normal and reverse directions to thereby cause the movable blade to be held at the cutting wait position and at the same time cause the tape feeding mechanism to feed the printing tape, and upon termination of the printing, the control block causing the motor to rotate in the another of the normal and reverse directions to cause the movable blade to be pivotally moved from the cutting wait position to the cutting terminal position until the encoder detects a predetermined rotational angle through which the rotational shaft of the motor has rotated when the movable blade has reached the cutting terminal position, and then causing the motor to stop to thereby cause the tape holding mechanism to hold the printed portion of the printing tape at the tape exit.

The above and other objects, features, and advantages of the invention will become more apparent from the following detailed description taken in conjunction with the accompanying drawings.

DETAILED DESCRIPTION

The invention will now be described in detail with reference to drawings showing a tape printing apparatus according to an embodiment thereof. The tape printing apparatus prints on a strip of printing tape as desired according to key entries and cuts off the printed portion of the printing tape. The cut-off strip of the printing tape is used as a label to be affixed to a file, a cable, or the like. That is, the tape printing apparatus makes a label printed with characters from plain printing tape. The plain printing tape and an ink ribbon to be consumed in the tape printing are contained in a tape cartridge, and fed to the main unit of the apparatus from the tape cartridge.

Figure 1:
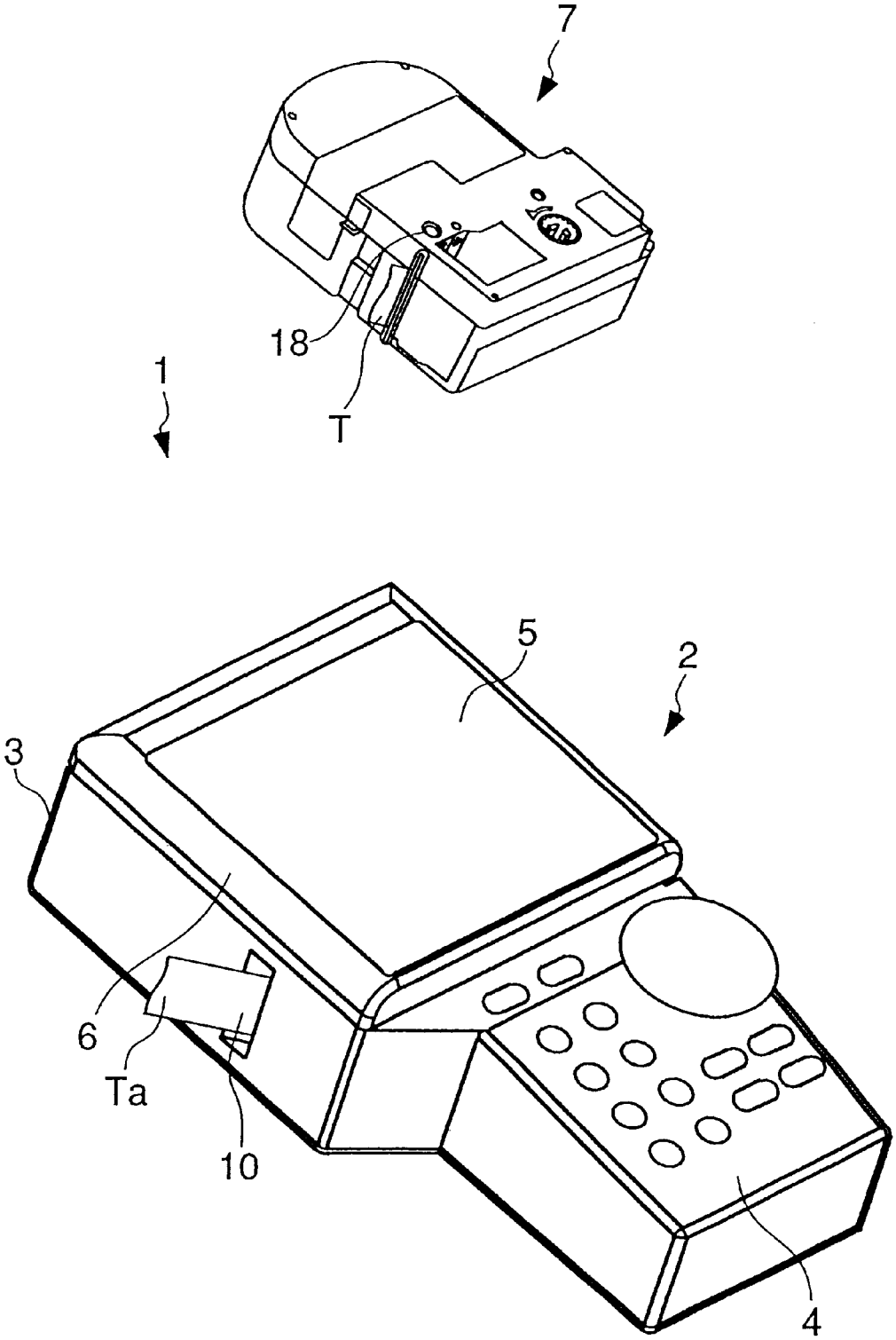
FIG. 1 is a perspective view of a tape printing apparatus according to an embodiment of the invention.
Figure 2:
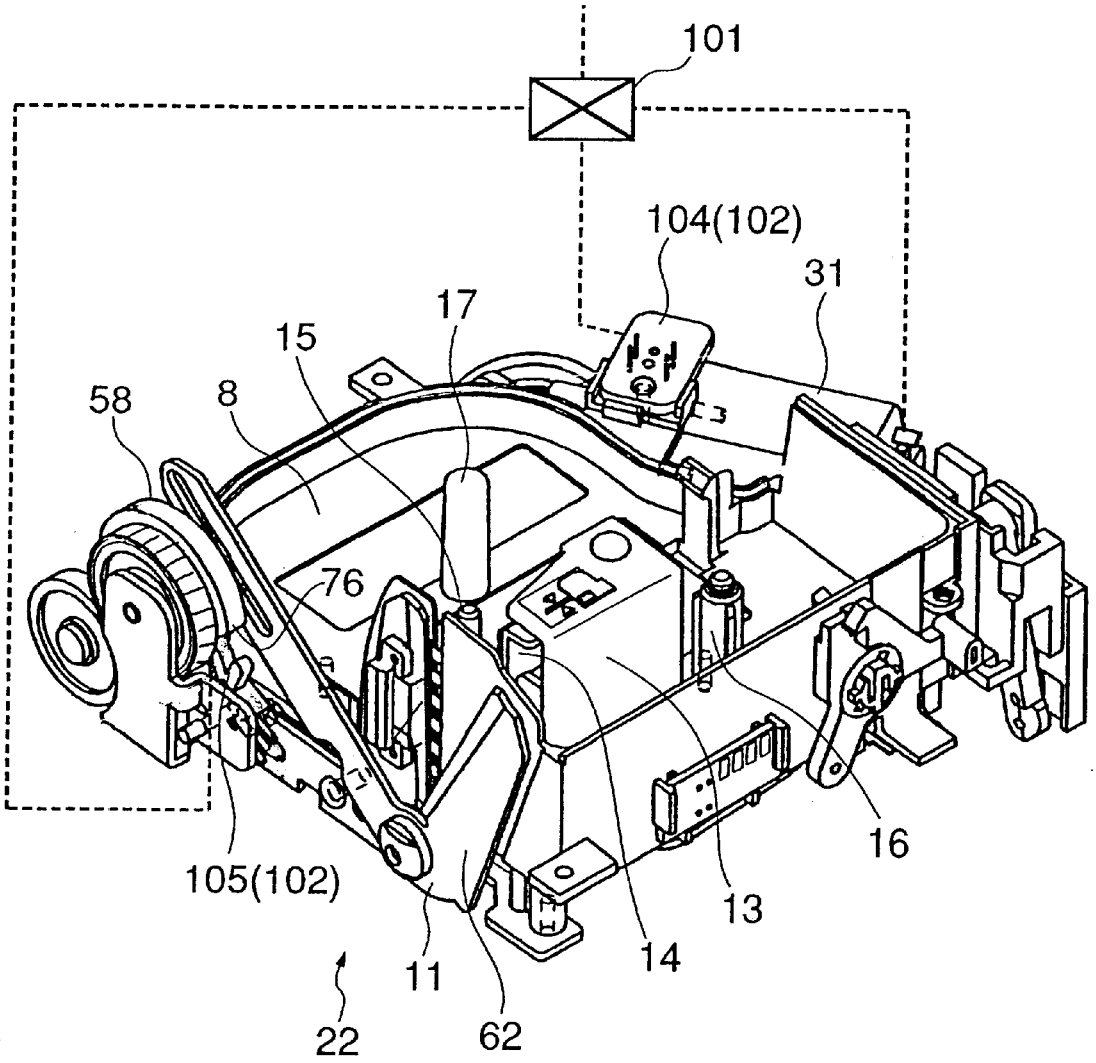
FIG. 2 is a perspective view of a cartridge compartment of the FIG. 1 tape printing apparatus and component parts associated with the cartridge compartment, as viewed from a cutter side.
Figure 3:
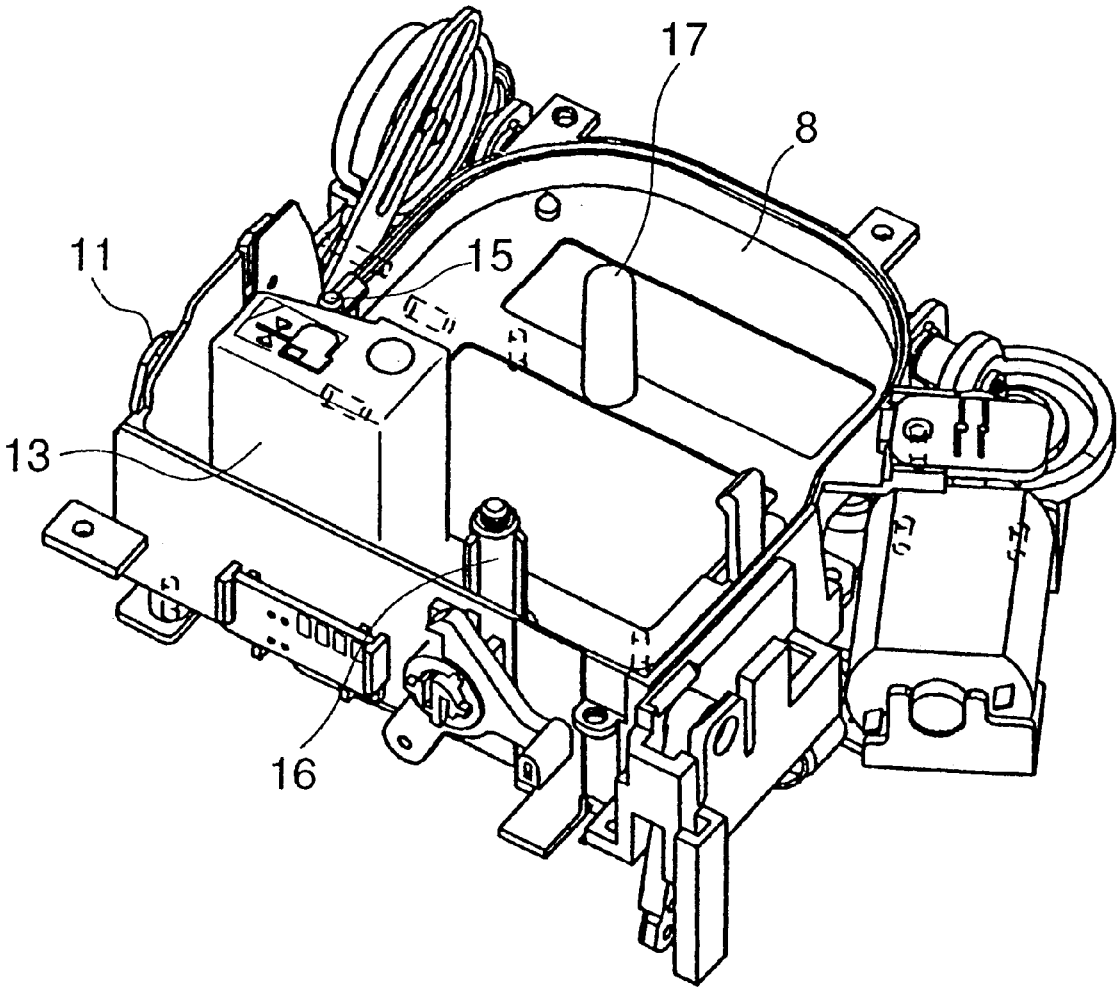
FIG. 3 is a perspective view of the FIG. 2 cartridge compartment and component parts associated therewith, as viewed from a motor side.

Referring first to FIG. 1, the tape printing apparatus 1 is a hand-held type whose main unit 2 has an apparatus casing 3 forming an outer shell of the main unit 2. The tape printing apparatus 1 has a key entry block 4 arranged at a front portion thereof and a lid 6 arranged at a rear portion thereof. The lid 6 incorporates a liquid crystal display 5 forming the outer surface of the lid 6. As shown in FIGS. 2 and 3, arranged under the lid 6 is a cartridge compartment 8 for accommodating a tape cartridge 7. Further, the apparatus casing 3 has a left side portion thereof formed with a tape exit 10 for communication between the cartridge compartment 8 and the outside of the apparatus 1, and a cutter 11 faces the tape exit 10, for cutting off a dispensed portion of the printing tape T (see FIGS. 1 and 2).

In the cartridge compartment 8, there are erected a print head 14 covered with a head cover 13, a platen shaft 15 opposed to the print head 14, a take-up shaft 16 for taking up used part of the ink ribbon, and a guide projection 17 for guiding the tape cartridge 7 in the cartridge compartment 8 when it is mounted therein. A platen 18 for engagement with the platen shaft 15 is arranged in the tape cartridge 7 (see FIG. 1).

The platen 18, the platen shaft 15, and the take-up shaft 16 form a tape feed mechanism 21 together with other components, referred to hereinafter, associated with the components 18, 15, 16, while the cutter 11 forms a tape cutting mechanism 22 together with other components, referred to hereinafter, associated with the cutter 11. The tape feed mechanism 21 and the tape cutting mechanism 22 are driven for operation by an identical drive source (motor) via a torque transmitting mechanism 23 and a clutch mechanism 24 arranged under the cartridge compartment 8 (which will be described in detail hereinafter). Further, the tape exit 10 incorporates a tape strip-holding mechanism 25 for holding a tape strip Ta at the tape exit 10 by pressing the same against a side wall of the tape exit 10 (which will also be described in detail hereinafter).

When a label is produced by using the tape printing apparatus 1, first, the lid 6 is opened, and then the tape cartridge 7 is pushed into the cartridge compartment 8 from above. When the loading of the tape cartridge 7 is completed, the lid 6 is closed to place the tape printing apparatus 1 in a printing wait state. Then, the user enters desired characters and figures by operating the key entry block 4 while watching the liquid crystal display 5. When the entry of the desired characters and figures is verified on the liquid crystal display 5, the key entry block 4 is further operated to input a print command.

When the print command is issued, the printing tape T and the ink ribbon contained in the tape cartridge 7 start to be rolled out simultaneously, and printing is effected on the printing tape T by the print head 14 in a desired manner. During the printing operation, used part of the ink ribbon is taken up within the tape cartridge 7, while a printed portion of the printing tape T is sent out of the apparatus 1 via the tape exit 10. When the printing operation is completed, the printing tape T is further fed by an amount corresponding to a trailing blank space or margin, and then the feed of the printing tape T and the ink ribbon is stopped. Then, the tape cutting mechanism 22 operates to cause the cutter 11 to cut off the printed portion of the printing tape T. The tape strip Ta cut off by the cutter 11 is held at the tape exit 10 such that it can be manually drawn out from the tape exit 10.

Figure 4:
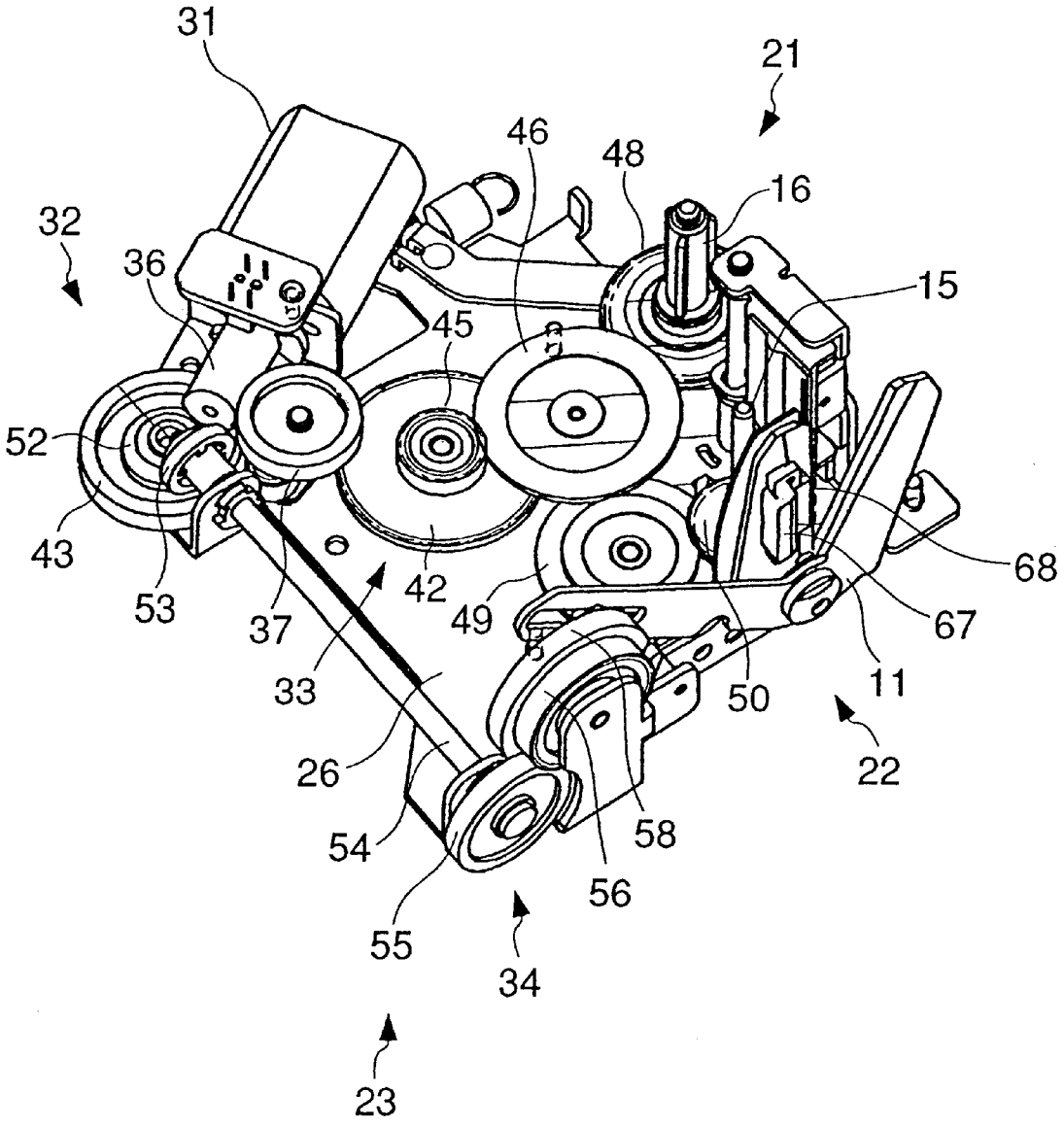
FIG. 4 is a perspective view of a whole drive system of the FIG. 1 tape printing apparatus.
Figure 5:
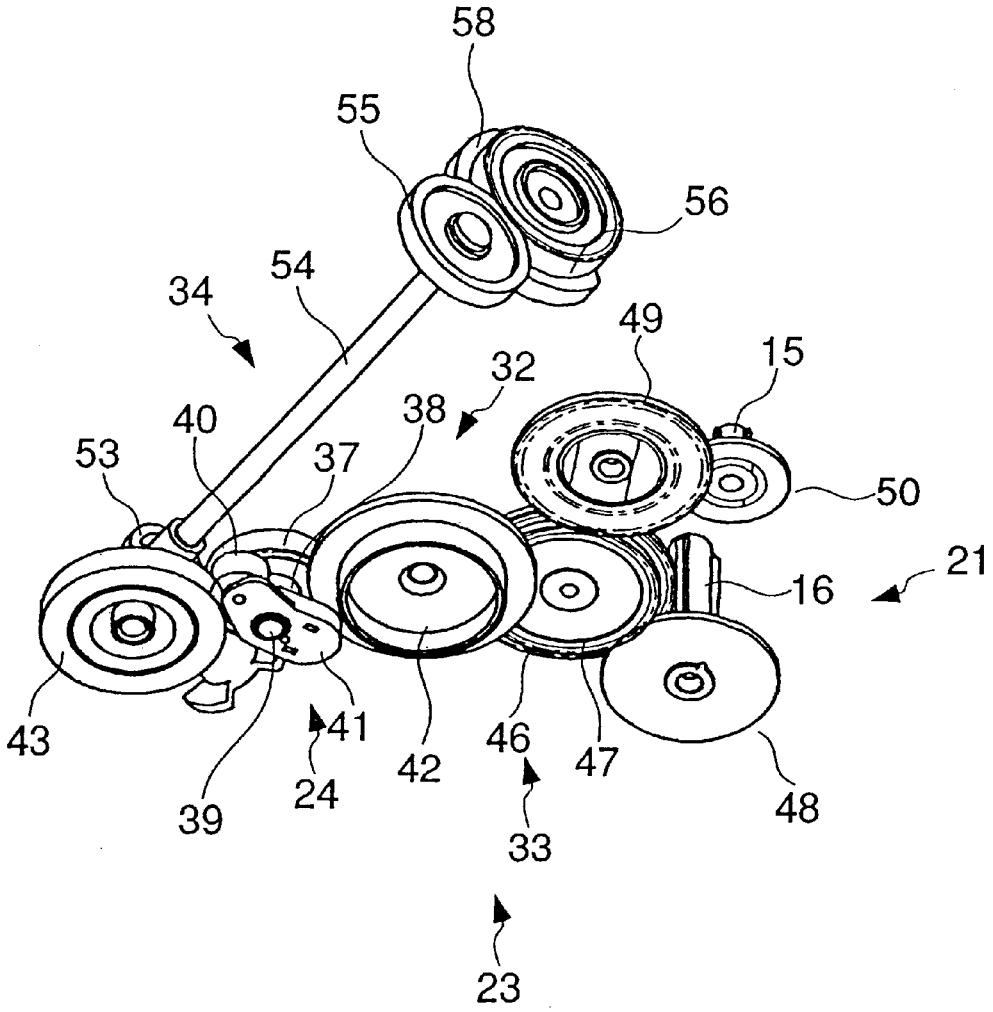
FIG. 5 is a perspective view of a gear train of the FIG. 4 drive system.

Next, the drive system of the apparatus 1 having the tape feed mechanism 21 and the tape cutting mechanism 22 as output ends of the driving system will be described in detail with reference to FIGS. 4 and 5. The drive system includes a motor 31, a driving block 32 comprised of a gear train linked to a main shaft of the motor 31, the clutch mechanism 24 linked to the driving block 32, the torque transmitting mechanism 23 comprised of a feed mechanism-side gear train 33 and a cutting mechanism-side gear train 34 with one of which the clutch mechanism 24 is selectively engaged, the tape feed mechanism 21 linked to the feed mechanism-side gear train 33, and the tape cutting mechanism 22 linked to the cutting mechanism-side gear train 34. The motor 31, the driving block 32, the clutch mechanism 24, and the torque transmitting mechanism 23 are mounted on a base frame 26 arranged in a space under the cartridge compartment 8.

The motor 31 is capable of rotating in normal and reverse directions. When the motor 31 performs normal rotation, the torque is transmitted from the driving block 32 to the clutch mechanism 24, and the clutch mechanism 24 switches to be connected with the feed mechanism-side gear train 33 to further transmit the torque to the feed mechanism-side gear train 33 and the tape feed mechanism 21. As a result, the platen shaft 15 and the take-up shaft 16 are rotated to feed the printing tape T and the ink ribbon simultaneously. On the other hand, when the motor 31 performs reverse rotation, the torque is transmitted from the driving block 32 to the clutch mechanism 24, and the clutch mechanism 24 switches to be connected with the cutting mechanism-side gear train 34 to further transmit the torque to the cutting mechanism-side gear train 34 and the tape cutting mechanism 22. As a result, the cutter 11 is operated to cut the printing tape T.

The motor 31 is formed by a DC motor and secured to the base frame 26 in a state slightly tilted with respect to the base frame 26 in view of space efficiency within the apparatus casing 3. The driving block 32 is comprised of a worm 36 rigidly fitted on the main shaft of the motor 31, a worm wheel 37 mating with the worm 36, a thick gear (output gear) 38 having a relatively large thickness and coaxially secured to the underside of the worm wheel 37, and a rotational shaft 39 on which the worm wheel 37 and the thick gear 38 are rigidly fitted (see FIGS. 6A and 6B). The torque of the motor 31 is transmitted via the worm 36 and the worm wheel 37 to the thick gear 38 from which the torque is input to the clutch mechanism 24.

Figure 6A:
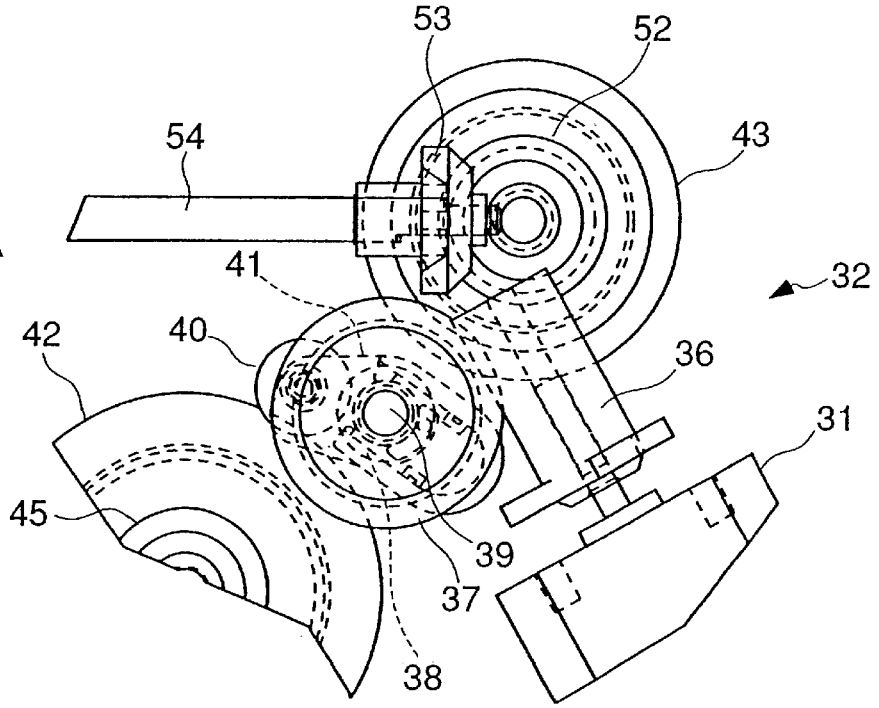
FIGS. 6A and 6B are enlarged plan views of a clutch mechanism of the FIG. 4 drive system and component parts associated with the clutch mechanism.
Figure 6B:
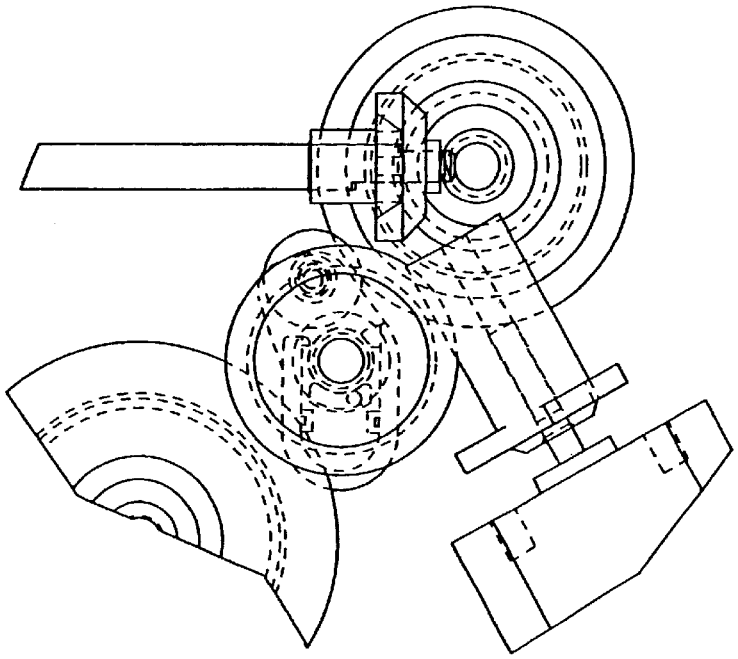

As shown in FIGS. 6A and 6B, the clutch mechanism 24 includes a planet gear 40 mating with the thick gear 38 and a carrier 41 which has an end portion rotatably supporting the planet gear 40 and is loosely fitted on the rotational shaft 39 in a manner movable with rotation of the shaft 39 by frictional drag therewith. When the motor 31 rotates in the normal direction, the worm wheel 37 and the thick gear 38 rotate in unison with the rotational shaft 39. When the rotational shaft 39 rotates, the carrier 41 is caused to rotate (or swing), by frictional drag, with the rotation of the rotational shaft 39 to cause the planet gear 40 to mate with an input gear 42 of the feed mechanism-side gear train 33. The torque of the thick gear 38 is transmitted to the planet gear 40 mating therewith, and then to the input gear 42 via the planet gear 40 at a time point the planet gear 40 has mated with the input gear 42, thereby causing rotation of the input gear 42 (see FIG. 6A). On the other hand, when the motor 31 performs reverse rotation, the rotational shaft 39 rotates in the reverse direction, whereby the carrier 41 rotates (or swings) to cause the planet gear 40 to mate with an input gear 43 of the cutting mechanism-side gear train 34. The torque of the thick gear 38 is transmitted to the planet gear 40, and then to the input gear 43 via the planet gear 40 at a time point the planet gear 40 has mated with the input gear 43, thereby causing rotation of the input gear 43 (see FIG. 6B).

The feed mechanism-side gear train 33 is comprised of the input gear 42, a first intermediate gear 45 coaxially secured to the top of the input gear 42, a second intermediate gear 46 mating with the first intermediate gear 45, a branching gear 47 coaxially secured to the underside of the second intermediate gear 46, a take-up gear 48 arranged on a take-up shaft side and mating with the branching gear 47, a reduction gear 49 arranged on a platen shaft side and also mating with the branching gear 47, and a platen gear 50 mating with the reduction gear 49.

The torque of the motor 31 input to the input gear 42 is transmitted to the first and second intermediate gears 45, 46 and then branched at the branching gear 47 to rotate the take-up gear 48 and the reduction gear 49. It should be noted that when torque is input to the platen gear 50 e.g. in the case of the printing tape T being drawn out by the user, the input gear 42 pushes the planet gear 40 away to thereby prevent transmission of this torque and at the same time causes rotation of the take-up gear 48 via the branching gear 47 without receiving any load from the motor 31. As a result, the ink ribbon is taken up by the take-up reel 16 as the printing tape T is drawn out, which prevents the ink ribbon from becoming loose.

The cutting mechanism-side gear train 34 is comprised of the input gear 43, an input bevel gear 52 coaxially secured to the top of the input gear 43, an output bevel gear 53 mating with the input bevel gear 52, a long shaft 54 having the output bevel gear 53 rigidly fitted on one end thereof, an intermediate gear 55 rigidly fitted on the other end of the shaft 54, and a cutter gear 56 mating with the intermediate gear 55. The torque of the motor 31 input to the input gear 43 is transmitted to the shaft 54 via the two bevel gears 52, 53, and then to the intermediate gear 55 via the shaft 54 to cause rotation of the cutter gear 56.

The tape feed mechanism 21 includes the platen 18 in rolling contact with the printing tape T and the ink ribbon, for feeding them, the platen shaft 15 for rotating the platen 18, and the take-up shaft 16 for taking up the ink ribbon. The platen 18 is incorporated in the tape cartridge 7 and brought into engagement with the platen shaft 18 when the tape cartridge 7 is loaded in the cartridge compartment 8. The platen shaft 15 is coaxially and fixedly attached to the platen gear 50 in a cantilever manner. The platen shaft 15 rotates in unison with the platen gear 50 to rotate the platen 18 engaging with the platen shaft 15. The take-up shaft 16 is coaxially and fixedly attached to the take-up gear 48 in a cantilever manner. The take-up shaft 16 receiving torque from the take-up gear rotates in unison therewith to cause rotation of a reel core of the ink ribbon engaging with the take-up shaft 16. The take-up shaft 16 is a sliding shaft which causes rotation of the reel core of the ink ribbon by frictional drag while properly sliding thereon to thereby cause the same to take up the ink ribbon.

Figure 7:
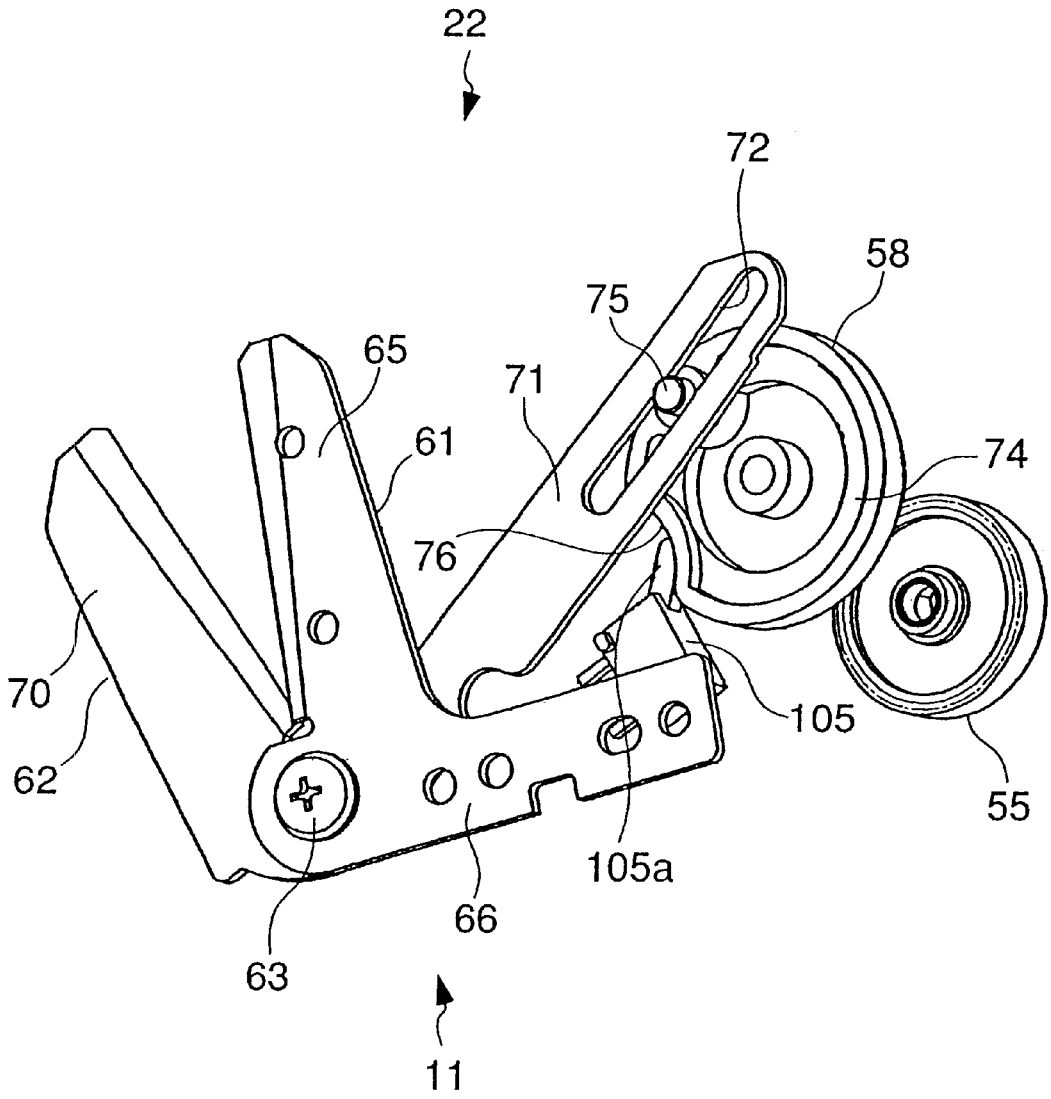
FIG. 7 is an enlarged perspective view of a tape cutting mechanism of the FIG. 4 drive system and component parts associated with the tape cutting mechanism.

As shown in FIG. 7, the tape cutting mechanism 22 includes the cutter 11 in the form of scissors and a crank disk 58 engaging with the cutter 11 to cause the same to perform a cutting operation. The cutter 11 is comprised of a stationary blade 61 and a movable blade 62. The two blades 61, 62 are coupled to each other by a pivot 63 such that the movable blade 62 can be pivotally moved to perform cutting operations on the stationary blade 61. The stationary blade 61 is comprised of a blade body 65 and a cutter arm 66 integrally formed with the blade body 65 and extending from the root of the blade body 65 substantially perpendicularly with respect to the same. The stationary blade 61 is attached to the base frame 26 by fixing the cutter arm 66 to the base frame 26. Attached to the blade body 65 of the stationary blade 61 are an oil absorber 67 containing silicone oil for preventing an adhesive on the printing tape T from adhering to the blade body 65 and a static-eliminating brush 68 for establishing a ground for generated static electricity (see FIG. 4).

The movable blade 62 is comprised of a blade body 70 and a cutter arm 71 integrally formed with the blade body 70 and extending from the root of the blade body 70 substantially perpendicularly with respect to the same, and the cutter arm 71 is formed with a slot 72 for constant engagement with the crank disk 58. The crank disk 58 is comprised of a disk body 74 and a crankpin 75 integrally formed on the disk body 74 at a location offset from the center of the same. The cutter gear 56 is coaxially secured to the reverse side of the crank disk 58 (see FIG. 4). The crankpin 75 is inserted into the slot 72 of the cutter arm 71 for engagement therewith. That is, the crank disk 58 and the cutter arm 71 form a wobble crank mechanism in which a rotation of the crank disk 58 causes the blade body 70 to perform a cutting operation (reciprocating motion) between a cutting terminal position (forward end position) at which the blade body 70 has slid on the stationary blade 61 and a cutting wait position (rearward end position) at which the blade body 70 is positioned farthest from the stationary blade 61.

It should be noted that, as described in detail hereinafter, a switch end 105*a* of a detection switch 105 is held in sliding contact with the outer peripheral surface of the crank disk 58 which is formed with an arcuate recess 76 for turning on the detection switch 105.

Figure 8:
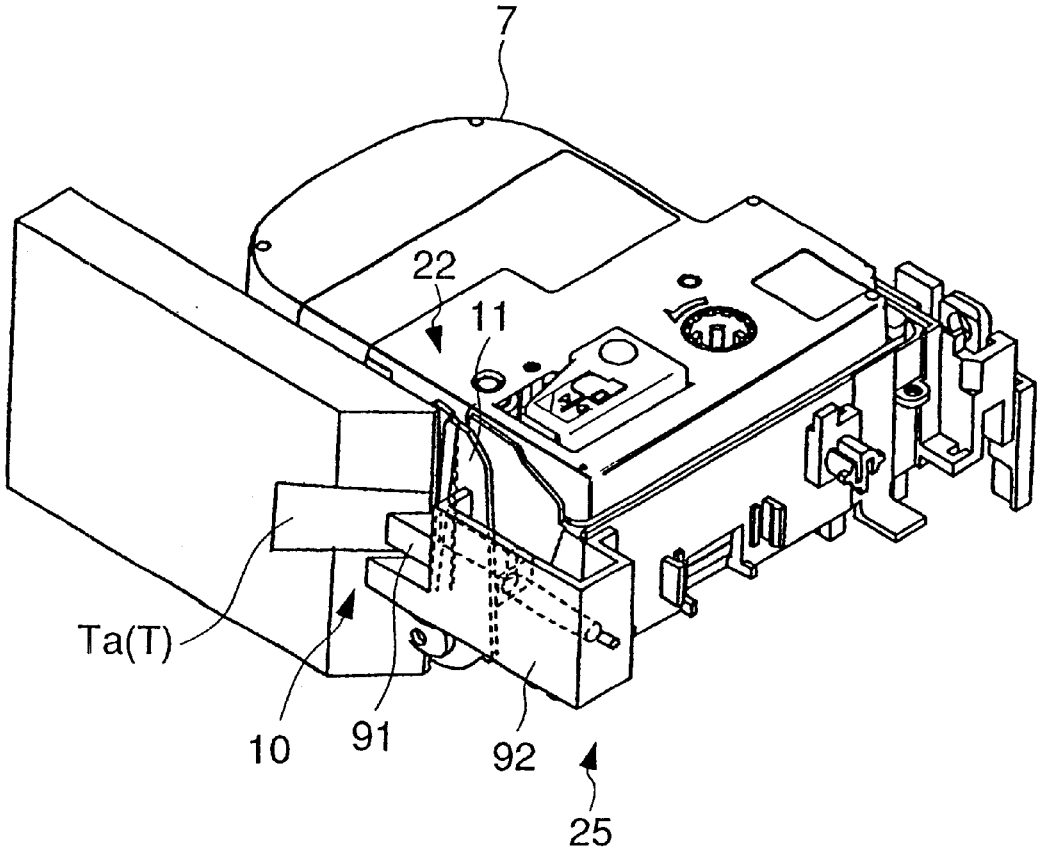
FIG. 8 is a perspective view of a tape strip-holding mechanism of the FIG. 1 tape printing apparatus and component parts associated with the tape strip-holding mechanism.
Figure 9A:
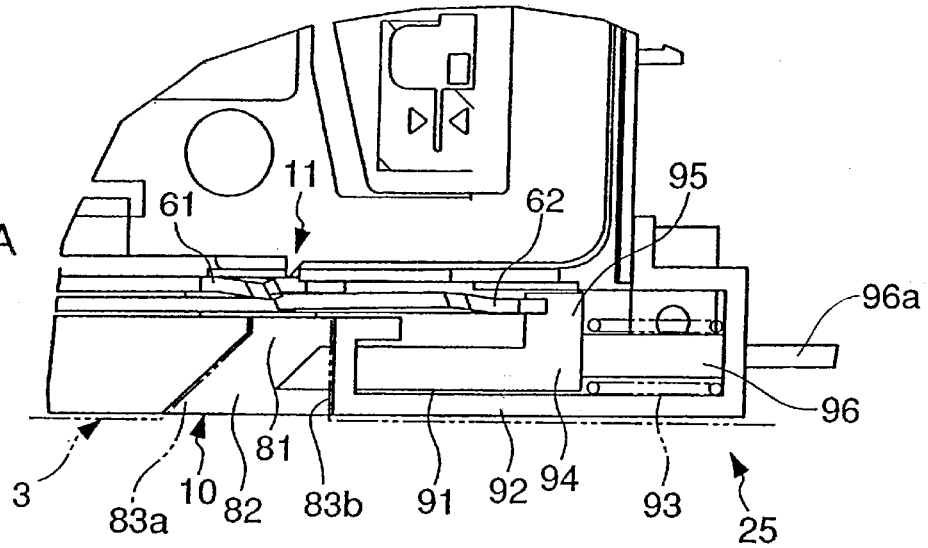
FIGS. 9A and 9B are enlarged plan views of the FIG. 8 tape strip-holding mechanism and component parts associated therewith.
Figure 9B:
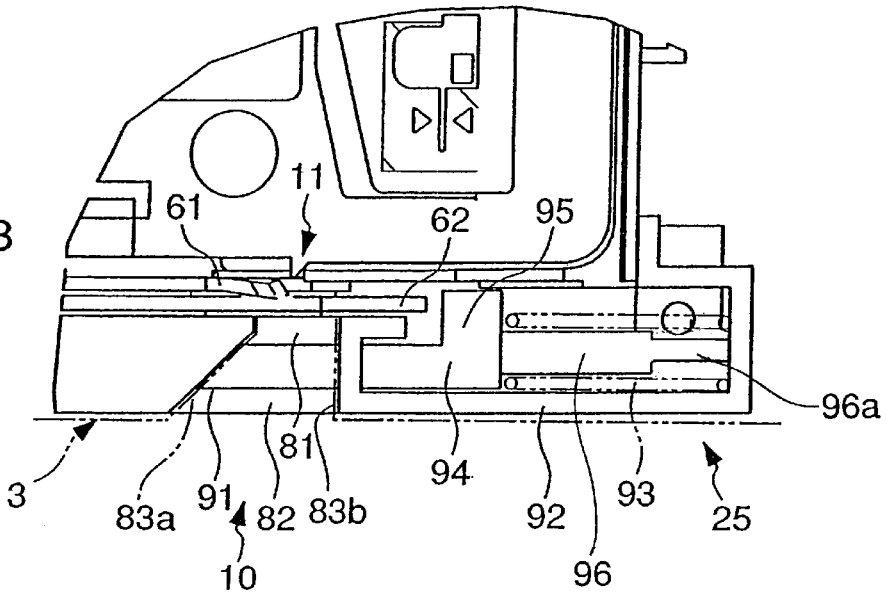

Next, the tape strip-holding mechanism 25 will be described in detail with reference to FIGS. 8 and 9A, 9B. As shown in FIG. 8, the tape exit 10 formed in the apparatus casing 3 as described hereinbefore is formed by a slit 81 having an open upper end, and an expanding opening 82 spreading outward from the slit 81 in a manner broadening toward the outer end of the tape exit 10. A portion of the apparatus casing 3 formed with the slit 81 contains the cutter 11 which performs a cutting operation along a cutting line substantially coincident with a center line of the slit 81. Further, the tape strip-holding mechanism 25 is arranged at a location inward (rightward as viewed in FIGS. 9A and 9B) of a movable blade-side opening wall 83*b* of the apparatus casing 3 forming a wall of the expanding opening 82, for pressing a cut-off tape strip Ta against a stationary blade-side opening wall 83*a*.

The tape strip-holding mechanism 25 includes a holding nail 91 for holding a tape strip Ta by pressing the same against the opening wall 83*a*, a nail holder 92 in the form of a case, for supporting the holding nail 91 such that it can reciprocate, and a coiled spring 93 for urging the holding nail 91 toward the opening wall 83*a*. The holding nail 91 is comprised of a nail 94 slidably extending through a hole formed through the movable blade side opening wall 83*b* and a hole formed through the wall of the nail holder 92, an engaging projection 95 extending inward from the root of the nail 94, and a rod 96 extending linearly from the extreme root end of the nail 94 and including a reduced-diameter portion 96*a* slidably extending through a hole formed through the wall of the nail holder 92, all of which are integrally formed as a unitary member. The holding nail 91 has forward and rearward portions, i.e. the nail 94 and the reduced-diameter portion 96*a* of the rod 96 supported by the nail holder 92 such that the nail 94 can reciprocate between its holding position at which the nail 94 is held in abutment against the stationary blade-side opening wall 83*a* in a state projected from the movable blade-side opening wall 83*b* and its release position at which the nail 94 is in a state retracted toward the inside of the movable blade-side opening wall 83*b*.

The holding nail 91 has a forward end face formed with a bevel such that it meets the surface of the stationary blade-side opening wall 83*a*. More specifically, the forward end face of the holding nail 91 is formed to have a shape complementary to that of the stationary blade-side opening wall 83*a* such that the forward end face can be held in surface contact with the surface of the opening wall 83*a*. Fitted on the rod 96 is the coiled spring 93 urging the holding nail 91 in a forward or projecting direction, with one end thereof held in abutment with the root end of the nail 94 and the other end thereof in abutment with an inner wall of the nail holder 92. The engaging projection 95 of the holding nail 91 urged as above is in contact with the back of the movable blade 62. Accordingly, the holding nail 91 moves forward and backward according to the cutting operation (pivotal reciprocating motion) of the movable blade 62 to project and retract through the movable blade-side opening wall 83*b*. It is preferable that the holding nail 91 reaches its holding position immediately before the movable blade 62 reaches its cutting terminal position.

In this preferred case, at the instant (which can be not exactly "the instant") of the cutter 11 having cut off the printing tape T, the holding nail 91 reaches the stationary blade-side opening wall 83*a* to hold a cut-off tape strip Ta between the surface of the stationary blade-side opening wall 83*a* and itself. This held or sandwiched state of the tape strip Ta is maintained until the next cutting operation starts. Therefore, in the present embodiment, in order to hold the holding nail 91 at its holding position, the cutting operation of the movable blade 61 is stopped when the movable blade 62 reaches its cutting terminal position, and a next cutting operation is started from the cutting terminal position of the movable blade.

Now, description will be made, with reference to FIG. 2, of a control system for causing the movable blade 62 to stop at its cutting terminal position. The control system (control means) includes a CPU 101 for centralized control of the motor 31 and the input/output devices, and a detector 102 for detecting a position of the movable blade 62 during a cutting operation. The detector 102 is comprised of an encoder 104 arranged in proximity to the main shaft of the motor 31, and the detection switch 105 arranged in proximity to the outer peripheral surface of the crank disk 58 of the tape cutting mechanism 22. The encoder 104 detects a rotational angle of the motor 31, while the detection switch 105 detects the cutting wait position of the movable blade 62 in cooperation with the recess 76 of the crank disk 58.

Before the start of printing, the movable blade 62 is in the cutting terminal position. In response to a print command, the CPU 101 causes the motor 31 to start reverse rotation. At this time, the torque of the motor 31 is transmitted by the clutch 24 to the cutting mechanism side to cause the rotation of the crank disk 58 whereby the movable blade 62 is pivotally moved toward the cutting wait position. When the switch end 105*a* of the detection switch 105 is let in the recess 76, the detection switch 105 is turned on to send a detection signal indicative of the sensed cutting wait position of the cutter 11 (movable blade 62) to the CPU 101. In response to the signal, the CPU 101 resets the encoder 104, and at the same time switches the rotation of the motor 31 from the reverse rotation to the normal rotation. According to this switching of the direction of rotation of the motor 31, the clutch mechanism 24 operates to cause the torque of the motor 31 to be transmitted to the tape feed mechanism 21 side. As a result, the movable blade 62 is maintained at the cutting wait position, and on the other hand, the printing on the printing tape T is carried out while feeding the printing tape T and the ink ribbon and causing the ink ribbon to be take up. When the printing is completed and further an additional feed of the printing tape T corresponding to a predetermined margin is completed, the CPU 101 switches the rotation of the motor 31 from the normal rotation to the reverse rotation. According to this switching, the clutch mechanism 24 operates to cause the torque of the motor 31 to be transmitted to the cutting mechanism 22 side. This causes the rotation of the crank disk 58 to be resumed, and the cutter in engagement with therewith is operated to cut off the printing tape. Almost simultaneously to this cutting of the printing tape, the encoder 104 detects that the crank disk 58 has rotated through a rotational angle corresponding to a half rotational turn thereof, and delivers a signal indicative of the sensed cutting terminal position of the movable blade 62 to the CPU 101. In response to this signal, the CPU 101 stops the rotation of the motor 31, whereby the movable blade is held at the cutting terminal position. That is, the cutting wait position is set as a home position of the cutter 11 (movable blade 62), and the movable blade 62 is stopped when it has pivotally moved to the cutting terminal position from the home position. Subsequently, when a print command instructing a next printing operation is received, the CPU 101 causes the reverse rotation of the motor 31 to be resumed, whereby the movable blade 62 is returned to its cutting wait position and held in the wait state. Upon completion of the printing operation, it is again caused to pivotally move to its cutting terminal position.

As described above, according to the present embodiment, since the tape feed mechanism 21 and the tape cutting mechanism 22 are both driven by the single motor 31 and by utilizing the normal and reverse rotations of the same, it is possible to reduce the number of motors by one and reduce space conventionally required for installment of two motors by half. This contributes to reduction of the manufacturing costs and size of the apparatus. Further, the use of the clutch mechanism which can be switched automatically by the normal and reverse rotations of the motor 31 makes it possible to dispense with a special mechanism for switching driving forces and hence simplify the construction of the apparatus.

It should be noted that a one-way clutch or the like may be used as the clutch mechanism.

It is further understood by those skilled in the art that the foregoing are preferred embodiments of the invention, and that various changes and modification may be made without departing from the spirit and scope thereof.

What is claimed is:

1. A tape printing apparatus which is capable of printing on a printing tape while feeding said printing tape by unwinding a roll of said printing tape, and cutting off a printed portion of said printing tape, the tape printing apparatus comprising:

a tape feed mechanism for feeding said printing tape;

a tape cutting mechanism for cutting said printing tape;

a single motor which is capable of performing rotation in normal and reverse directions;

a first torque transmitting mechanism for transmitting torque of said motor to said tape feed mechanism to cause said tape feed mechanism to operate;

a second torque transmitting mechanism for transmitting said torque of said motor to said tape cutting mechanism to cause said tape cutting mechanism to operate; and a clutch mechanism interposed between and selectively coupling said motor to said first torque transmitting mechanism and to said second torque transmitting mechanism, the clutch mechanism performing switching operation to selectively transmit said torque of said motor to said first torque transmitting mechanism when said motor rotates in one of said normal and reverse directions, and to transmit said torque of said motor to said second torque transmitting mechanism when said motor rotates in another of said normal and reverse directions.

2. A tape printing apparatus according to claim 1, including an output gear from which said torque of said motor is output, and a rotational shaft on which said output gear is rigidly fitted, and wherein said first torque transmitting mechanism includes a feed mechanism-side gear train for transmitting said torque of said motor to said tape feed mechanism, said feed mechanism-side gear train having an input gear, and said second torque transmitting mechanism includes a cutting mechanism-side gear train for transmitting said torque of said motor to said tape cutting mechanism, said cutting mechanism having an input gear, wherein said clutch mechanism includes a planet gear mating with said output gear, and a carrier having one end thereof supporting said planet gear such that said planet gear is rotatable thereon and another end thereof loosely fitted on said rotational shaft on which said output gear is rigidly fitted such that said carrier is capable of pivotal movement, by frictional drag, with rotation of said rotational shaft, said planet gear being mated with said input gear of said feed mechanism-side gear train by said rotation of said motor in said one of said normal and reverse directions, and mated with said input gear of said cutting mechanism-side gear train by said rotation of said motor in said another of said normal and reverse directions.

3. A tape printing apparatus according to claim 2, including an ink ribbon to be fed in a state placed upon said printing tape, wherein said tape feed mechanism includes a platen for feeding said printing tape and said ink ribbon in a state placed one upon another, a platen shaft for rotating said platen, a ribbon take-up reel for taking up said ink ribbon, and a ribbon take-up shaft for rotating said ribbon take-up reel, and said feed mechanism-side gear train including a platen gear on which said platen shaft is coaxially secured and a take-up gear on which said ribbon take-up shaft is coaxially secured, as respective output ends thereof.

4. A tape printing apparatus according to claim 2, wherein said tape cutting mechanism includes a stationary blade and a movable blade that perform relative motion therebetween for cutting operation, and a crank disk for engaging with said movable blade to cause said movable blade to effect said cutting operation, and said cutting mechanism-side gear train including a cutter gear coaxially secured to said crank disk as an output end of said cutting mechanism-side gear train.

5. A tape printing apparatus according to claim 3, wherein said tape cutting mechanism includes a stationary blade and a movable blade that perform relative motion therebetween for cutting operation, and a crank disk for engaging with said movable blade to cause said movable blade to effect said cutting operation, and said cutting mechanism-side gear train including a cutter gear coaxially secured to said crank disk as an output end of said cutting mechanism-side gear train.

6. A tape printing apparatus according to claim 4, including a tape exit from which said printed portion of said printing tape is discharged, and a tape holding mechanism associated with said tape exit and linked to said tape cutting mechanism, for holding said printed portion cut off by said tape cutting mechanism.

7. A tape printing apparatus according to claim 5, including a tape exit from which said printed portion of said printing tape is discharged, and a tape holding mechanism associated with said tape exit and linked to said tape cutting mechanism, for holding said printed portion cut off by said tape cutting mechanism at said tape exit.

8. A tape printing apparatus according to claim 6, including a control block for controlling the rotation of said motor, and wherein said control block controls the rotation of said motor such that when said movable blade has reached a cutting terminal portion as an end position in a cutting direction of said movable blade by said rotation of said motor in said another of said normal and reverse directions, said printed portion is held at said tape exit by said tape holding mechanism.

9. A tape printing apparatus according to claim 7, including a control block for controlling the rotation of said motor, and wherein said control block controls the rotation of said motor such that when said movable blade has reached a cutting terminal portion as an end position in a cutting direction of said movable blade by said rotation of said motor in said another of said normal and reverse directions, said printed portion is held at said tape exit by said tape holding mechanism.

10. A tape printing apparatus according to claim 8, including a printing block for printing on said printing tape, and wherein said motor includes a rotational shaft, and wherein said crank disk has a peripheral surface and a recess formed in said peripheral surface, said recess having an arcuate profile in cross-section, and wherein said control block includes an encoder arranged in proximity to said rotational shaft of said motor, for detecting a rotational angle through which said rotational shaft of said motor rotates, and a detection switch in abutment with said peripheral surface of said crank disk, said detection switch moving into said recess when said movable blade has reached a cutting wait position, and generating a cutting wait position detection signal indicative of said cutting wait position of said movable blade, and wherein said control block causes said motor to rotate in said another of said normal and reverse directions in response to a print command to thereby cause said movable blade to be pivotally moved to said cutting wait position, and in response to said cutting wait position detection signal, causes said motor to rotate in said one of said normal and reverse directions to thereby cause said movable blade to be held at said cutting wait position and at the same time cause said tape feeding mechanism to feed said printing tape, and wherein upon termination of said printing, said control block causes said motor to rotate in said another of said normal and reverse directions to cause said movable blade to be pivotally moved from said cutting wait position to said cutting terminal position until said encoder detects a predetermined rotational angle through which said rotational shaft of said motor has rotated when said movable blade has reached said cutting terminal position, and then causes said motor to stop to thereby cause said tape holding mechanism to hold said printed portion of said printing tape at said tape exit.

11. A tape printing apparatus according to claim 9, including a printing block for printing on said printing tape, and wherein said motor includes a rotational shaft, and wherein said crank disk has a peripheral surface and a recess formed in said peripheral surface, said recess having an arcuate profile in cross-section, and wherein said control block includes an encoder arranged in proximity to said rotational shaft of said motor, for detecting a rotational angle through which said rotational shaft of said motor rotates, and a detection switch in abutment with said peripheral surface of said crank disk, said detection switch moving into said recess when said movable blade has reached a cutting wait position, and generating a cutting wait position detection signal indicative of said cutting wait position of said movable blade, and wherein said control block causes said motor to rotate in said another of said normal and reverse directions in response to a print command to thereby cause said movable blade to be pivotally moved to said cutting wait position, and in response to said cutting wait position detection signal, causes said motor to rotate in said one of said normal and reverse directions to thereby cause said movable blade to be held at said cutting wait position and at the same time cause said tape feeding mechanism to feed said printing tape, and wherein upon termination of said printing, said control block causes said motor to rotate in said another of said normal and reverse directions to cause said movable blade to be pivotally moved from said cutting wait position to said cutting terminal position until said encoder detects a predetermined rotational angle through which said rotational shaft of said motor has rotated when said movable blade has reached said cutting terminal position, and then causes said motor to stop to thereby cause said tape holding mechanism to hold said printed portion of said printing tape at said tape exit.

12. A tape printing apparatus according to claims 6 or 7, wherein said tape holding mechanism includes a holding nail for holding said printed portion by pressing the same against a stationary blade-side opening wall of said tape exit, a nail holder in the form of a case supporting the holding nail for reciprocating movement, and a coil spring for urging said holding nail toward said stationary blade-side opening wall.

13. A tape printing apparatus according to claim 12, wherein said holding nail is comprised of a nail slidably extending through a first hole formed through a movable blade side opening wall and a second hole formed through a wall of said nail holder, and a rod extending linearly from an extreme root end of said nail and including a reduced-diameter portion slidably extending through a third hole formed through said wall of said nail holder.

14. A tape printing apparatus according to claim 13, wherein said holding nail has forward and rearward portions, said nail formed in said forward portion and said reduced-diameter portion of said rod formed in said rearward portion are supported by said nail holder so that said holding nail can reciprocate between a holding position at which said nail is held in abutment against said stationary blade-side opening wall in a state projected from said movable blade-side opening wall via said first hole and a release position at which said nail is in a retracted state toward an inside of said movable blade-side opening wall via said first hole.

15. A tape printing apparatus according to claim 14, wherein said holding nail has a forward end face formed to have a shape complementary to that of said stationary blade-side opening wall such that said forward end face can be held in surface contact with a surface of said stationary blade-side opening wall.

16. A tape printing apparatus according to claim 14, wherein said holding nail further comprises an engaging projection extending inward from the root of said nail, said coil spring fitted on said rod urges said nail in said projecting direction with one end of said nail held in abutment with said root of said nail and the other end of said nail held in abutment with an inner wall of said nail holder, and said engaging projection of said holding nail is in contact with a back of said movable blade, and thereby said holding nail moves forward and backward according to the cutting operation of said movable blade to project and retract through said first hole of said movable blade-side opening wall.

* * * * *